United States Patent [19]

Torichigai et al.

[11] Patent Number: 4,854,614

[45] Date of Patent: Aug. 8, 1989

[54] CABLE INSERT NOZZLE

[75] Inventors: Masaaki Torichigai; Keiichi Iwamoto, both of Nagasaki, Japan

[73] Assignee: Mitsubishi Jukogyo Kabushiki Kaisha, Tokyo, Japan

[21] Appl. No.: 7,896

[22] Filed: Jan. 28, 1987

[30] Foreign Application Priority Data

Jan. 30, 1986 [JP] Japan ..... 61-11932[U]
Apr. 23, 1986 [JP] Japan ..... 61-6015[U]
Sep. 12, 1986 [JP] Japan ..... 61-140341[U]

[51] Int. Cl.[4] ..... F16L 35/00

[52] U.S. Cl. ..... 285/93; 285/268; 285/906; 73/865.8; 73/866.5

[58] Field of Search ..... 285/267, 268, 269, 93, 285/906; 403/131, 197; 73/430, 865.8, 866.5

[56] References Cited

U.S. PATENT DOCUMENTS 713,347 11/1902 Reilly ..... 285/269 X
745,482 12/1903 Connelly ..... 285/268 X
826,454 7/1906 Timmer ..... 285/268
3,411,373 11/1968 Zieber et al. ..... 403/197 X
3,477,748 11/1969 Tinsley ..... 285/267
4,322,098 3/1982 Worshowsky ..... 285/269 X

FOREIGN PATENT DOCUMENTS 608847 8/1926 France ..... 285/268
843968 8/1960 United Kingdom .
1003540 9/1965 United Kingdom ..... 285/267

*Primary Examiner*—Dave W. Arola
*Attorney, Agent, or Firm*—Wenderoth, Lind & Ponack

[57] ABSTRACT

A two-part type cable insert nozzle has spherical seats formed on a female die and a male die. An automatic restoring member restores the female die to coaxial alignment with the male die. The automatic restoring member may include a pressing element surrounding the male die between a nozzle holder for coupling together the female die and the male die and a flange portion fixedly secured to the outer circumference of a tubular portion of the male die and spaced from and opposed to the nozzle holder. Alternatively, the member may be a spring provided within cable insert holes extending through the male die and the female die.

8 Claims, 4 Drawing Sheets

CABLE INSERT NOZZLE

BACKGROUND OF THE INVENTION

1. Field of the Invention

The present invention relates to a cable insert nozzle that is suitable as a nozzle of a manipulator for inserting a cable associated with a sensor into a heat-exchanger tube in non-destructive inspection of various types of heat-exchanger tubes.

2. Description of the Prior Art

For non-destructive inspection of heat-exchanger tubes of thermal power installations and atomic power, supersonic defect hunting and eddy current defect hunting have been generally employed, and in either of such defect hunting processes, inspection is carried out by inserting a cable associated with a float having a sensor at its tip end into the heat-exchanger tubes through other end portions thereof with the aid of pressurized water or compressed air.

FIG. 8 shows the state where a cable associated with a float is being inserted into a heat-exchanger tube via a nozzle of a manipulator, that is brought into press contact with a tube end portion of the heat-exchanger tube (header plate), with the aid of pressurized water or compressed air. One example of the cable insert nozzle of the prior art now will be explained with reference to FIG. 8.

In FIG. 8, a heat-exchanger tube 1 is subjected to seal welding 3 after it has been inserted into a counter-bored portion of a header plate 2. A nozzle portion of a manipulator is divided into a female die 4 and a male die 5 of spherical type which are coupled together by means of a nozzle holder 6 and nozzle cap screws 7. On a seat surface of the female die 4 is mounted a packing 8 made of rubber for the purpose of preventing leakage of pressurized water or compressed air.

The above-described female die 4 and male die 5 have extending therethrough cable insert holes 4*a* and 5*a*, respectively. At the front or inner portion of female die 4 is provided an opening 4*b* for projection therethrough of a cable. Further more, on a cable 9 is mounted a float 9*a* for the purpose of generating a thrust force for transporting (inserting and retracting) the cable 9. It is to be noted that the characteristic feature of the illustrated nozzle resides in that the nozzle is divided into two parts and a spherical seat is provided. Thereby, even in the event that deviation of the axis of the nozzle due to flexure of the manipulator should arise, sealing between the end portion of the tube and the packing 8 can be maintained.

FIG. 9 shows the state where the nozzle has been brought into press contact with a tube end portion after the manipulator was moved by one pitch for the purpose of inspection of the next tube. The nozzle in the prior art lacked the capability of restoring the female die 4 to alignment with the axis of the male die 5 upon separating the nozzle from the tube end portion after completion of an inspection. Therefore, upon inserting the nozzle or moving the nozzle by one pitch, the axes of the female die 4 and the male die 5 may deviate from each other. This, even if the nozzle is moved by one pitch according to drawings for manufacture of the heat-exchanger, it is difficult to insert the nozzle into the next tube end portion.

SUMMARY OF THE INVENTION

It is therefore one object of the present invention to provide an improved cable insert nozzle of the two-part type that overcomes the above-mentioned prior art disadvantages.

According to one feature of the present invention, there is provided a cable insert nozzle of the two-part type wherein a spherical seat is formed between a male die or nozzle member and a female die or nozzle member, and wherein automatic storing means for restoring the female die to a predetermined position is provided between the male die and the female die.

According to another feature of the present invention, there is provided a cable insert nozzle of the two-part type as described above, wherein pressing means such as an integral coil spring, a leaf spring or a sealed fluid device, or a plurality of coil springs, leaf springs or sealed fluid devices, is disposed between a nozzle holder for coupling together a male die and a female die and a flange portion fixedly secured to the outer circumference of a tubular portion of the male die and spaced from and opposed to the nozzle holder so as to surround the male die.

According to still another feature of the present invention, there is provided a cable insert nozzle including a female die that is rotatably fitted around a spherical seat of a male die, cable insert holes extending through the male die and the female die, and a coil spring mounted in the cable insert holes, such that the female die is spring-biased by the coil spring.

In the nozzle according to the present invention, since automatic restoring means as described above is disposed between the male die and the female die, when the nozzle is separated from a tube end portion or a hole in a header plate, the female die is always restored to a position coaxially aligned with the male die, whereby the inherent capability or function of the spherical seat still is provided. Therefore, insertion of the nozzle into a tube end portion always may be achieved easily.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Description now will be made of a first preferred embodiment of the present invention with reference to FIGS. 1 and 2.

Figure 1:
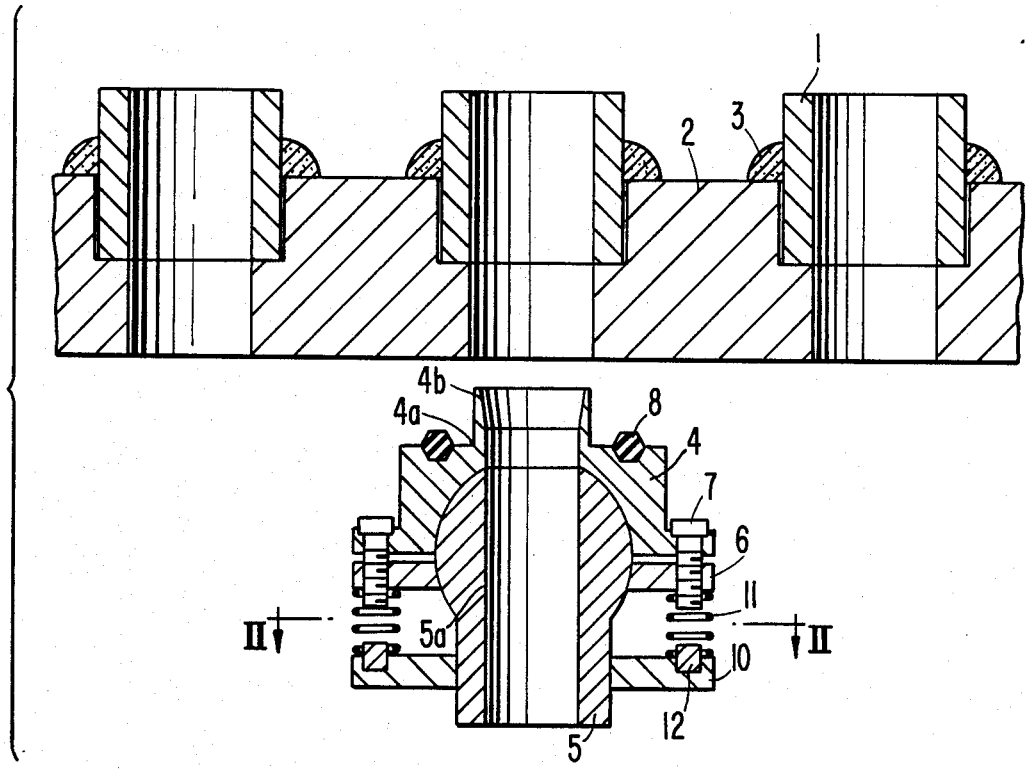
FIG. 1 is a longitudinal cross-sectional view of a first preferred embodiment of the present invention.
Figure 2:
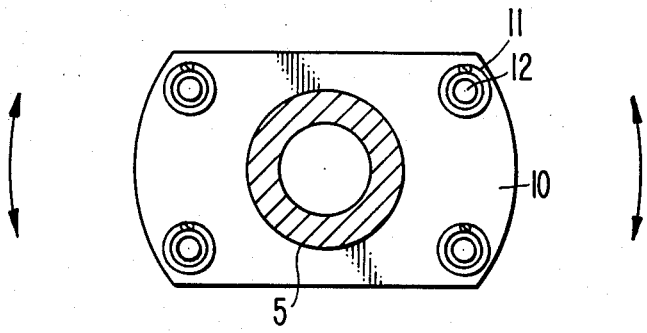
FIG. 2 is a transverse cross-sectional view of the same taken along line II—II in FIG. 1.
Figure 8:
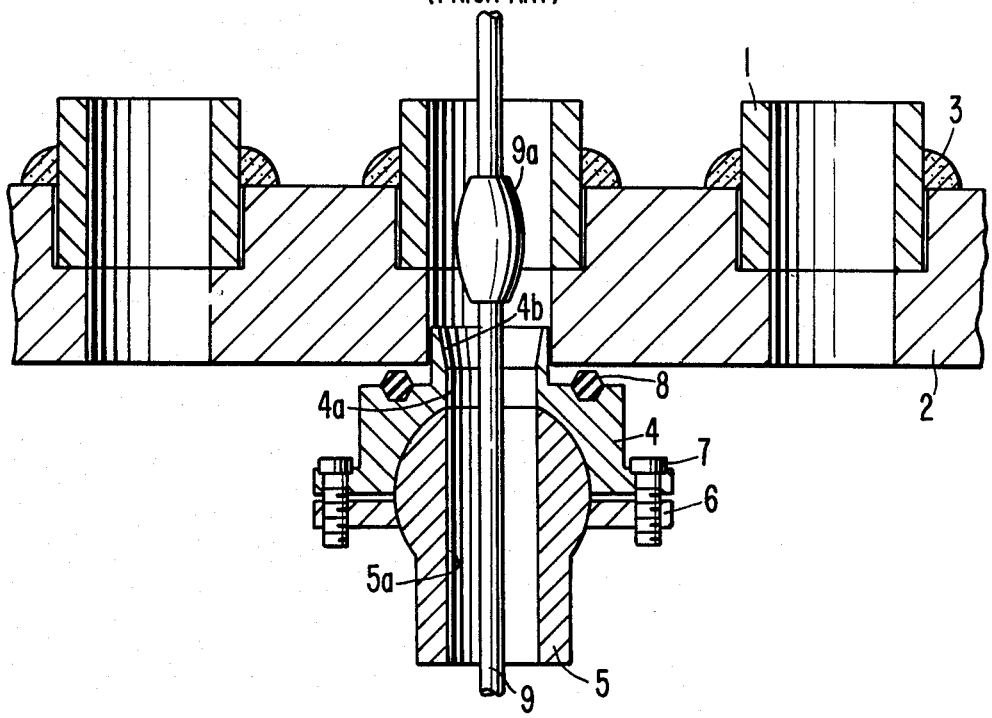
FIG. 8. (PRIOR ART)
FIGS. 8 and 9 are longitudinal cross-sectional views showing one example of a prior art cable insert nozzle during different states of use.
Figure 9:
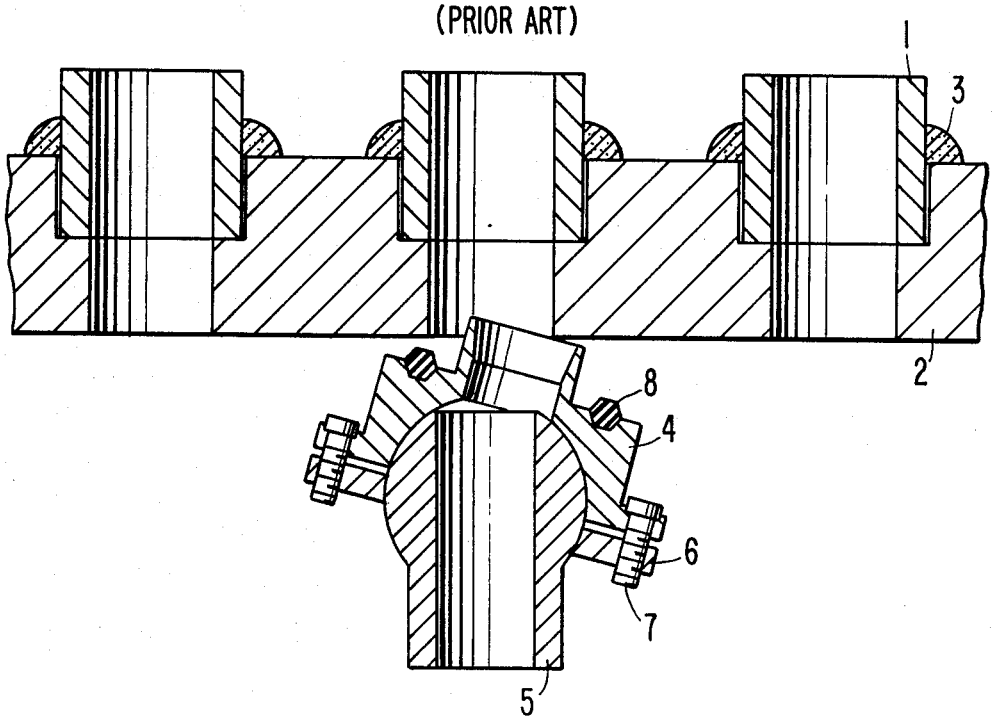
FIG. 9. (PRIOR ART)

In FIGS. 1 and 2, components identical to those shown in FIGS. 8 and 9 are given like reference numerals and further explanation thereof will be omitted herein.

A nozzle holder 6 for coupling together a female die or nozzle member 4 and a male die or nozzle member 5 is mounted on the female die 4 by means of nozzle cap screws 7 as shown in FIGS. 1 and 2, and flange 10 is fixedly secured around a tubular or cylindrical portion of the male die 5 in opposed relation to the nozzle holder 6. Between the flange 10 and the nozzle holder 6 (i.e. around the neck portion of a nozzle) are disposed four coil springs 11 having an identical wire diameter, an identical outer diameter and an identical number of turns and surrounding the male die 5 so as to form a rectangle therearound. It is to be noted that the number of the coil springs 11 is not limited to four but it could be three or more than four, and they could be disposed along an identical circumference.

When the nozzle is separated from a tube end portion, the female die 4 always is restored to its position coaxial with the axis of the male die 5. Thus, the alignment of the spherical seat is not lost, and merely by moving the nozzle by one pitch along the drawing for manufacture of the heat-exchanger it always will be possible to insert the nozzle into the next tube end portion. In addition, upon insertion into the tube end portion, even if an opening 4*b* of the female die 4 should have a slight positional error with respect to the hole in the header plate, the female die 4 would rotate owing to the spherical seat formed between the female die 4 and the male die 5,00 and thereby any such dispositional error can be eliminated.

In the illustrated embodiment, the upper ends of the four coil springs 11 are fitted around projected portions of the nozzle cap screws 7, while the lower ends of the coil springs 11 are fitted around pins 12 fixedly secured to the flange 10. In order to reduce backlash at the fitted portions, the inner diameter of the coil spring 11 is made slightly larger than the outer diameters of the nozzle cap screws 7 and the pins 12.

Figure 3:
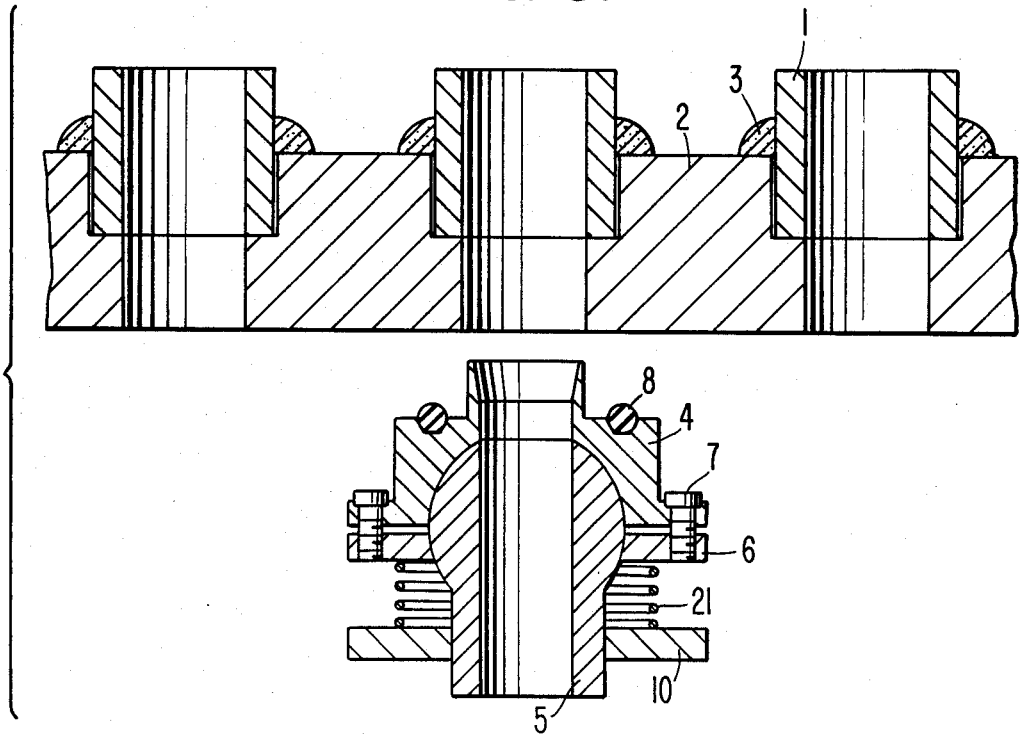
FIG. 3 is a longitudinal cross-sectional view of a second preferred embodiment of the present invention.

A second preferred embodiment of the present invention illustrated in FIG. 3 now will be explained.

Around a tubular portion of male die 5 is provided flange 10 in opposed relation to nozzle holder 6 for coupling together female die 4 and male die 5, and between the flange 10 and the nozzle holder 6 (i.e. around a neck portion of a nozzle) is disposed an integral coil spring 21 so as to surround the male die 5. In this case, the both ends of the coil spring 21 are flattened so that the spring will be equally loaded by the surface pressure from the nozzle holder 6 and by the surface pressure from the flange 10.

Consequently, when the nozzle is separated from a tube end portion, the female die always is restored to a position coaxial of the axis of the male die 5. Thus the alignment of the spherical seat is not lost, and merely by moving the nozzle by one pitch along the drawing for manufacture of the heat-exchanger it always will be possible to insert the nozzle into the next tube end portion.

Figure 4:
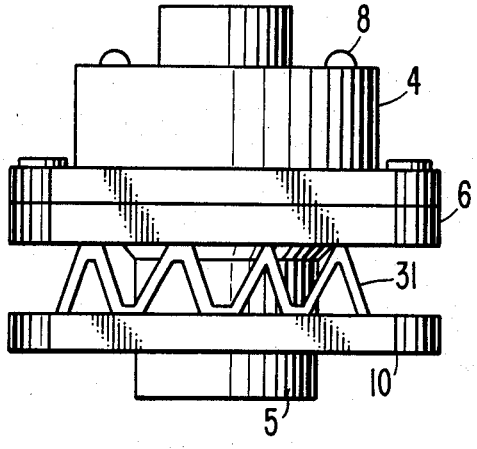
FIGS. 4 through 6, respectively, are front views showing third, fourth and fifth preferred embodiments of the present invention.
Figure 5:
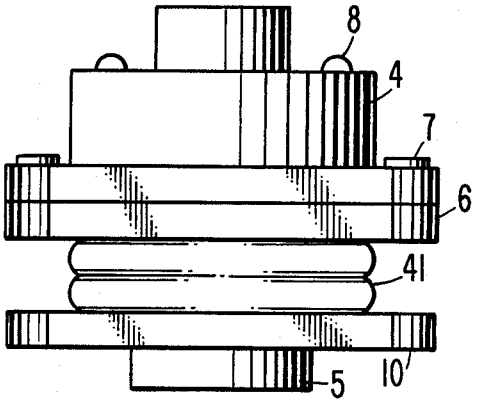
Figure 6:
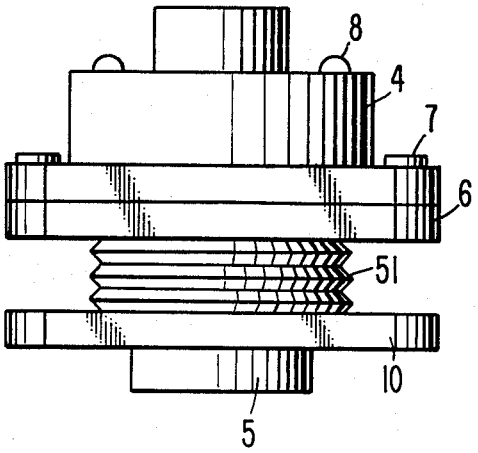

The second preferred embodiment, employing coil spring 21, is one example of the use of an integral pressing means. However, in place of such arrangement, modified embodiments can be made such that a leaf spring 31 is utilized as shown in FIG. 4, a sealed fluid device 41 formed by filling pressurized fluid into a flexible bladder is utilized as shown in FIG. 5, or a bellows-shaped cylindrical body 51 made of sufficiently elastic metal is utilized as shown in FIG. 6. Further, such pressing means may be divided into a plurality of pressing means which are disposed on an identical circumference or an identical rectangle which surrounds the periphery of the male die.

Figure 7:
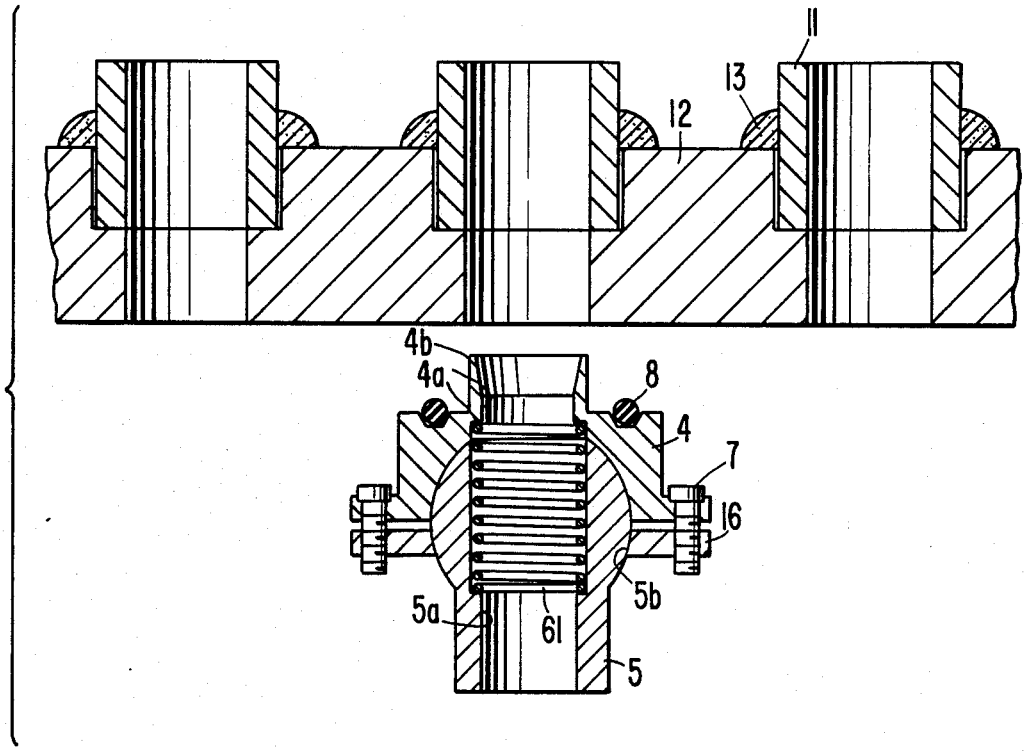
FIG. 7 is a longitudinal cross-sectional view of a sixth preferred embodiment of the present invention.

A sixth preferred embodiment of the present invention is shown in FIG. 7, wherein reference numeral 11 designates heat-exchanger tubes disposed within a heat-exchanger, and an end portion of each tube 11 is fitted in a counterbored portion of a header plate 12 and then fixedly secured by seal welding 13.

This preferred embodiment comprises, in a manner similar to the above-described embodiments, a male die 5, a female die 4 rotatably fitted around a spherical seat 5*b* of the male die 5 by means of a nozzle holder 6 and screws 7, and a series of cable insert holes 5*a* and 4*a* extending through the male die 5 and the female die 4. A packing 8 is fitted in a seat surface portion of the female die 4, and insert opening 4*b* is provided at a front or inner projections portion of the female die 4. A coil spring 61 is mounted within and extends through recesses formed within the cable insert hole 5*a* of the male die 5 and the cable insert hole 4*a* of the female die 4, so that the female die 4 is spring-biased to a predetermined position on the spherical seat 5*b*, thereby being automatically restored to such position and held thereat.

Since this illustrated embodiment is constructed in the above-described manner, the female die 4 is rotatable along the spherical seat 5*b* of the male die 5 upon deformation of the coil spring 61, and when the opening 4*b* of the female die 4 is separated from a bored portion of the header plate (or a tube end portion) and thus released, the female die 4 is automatically restored to the predetermined position on the spherical seat 5*b* by the restoring force of the coil spring 61. That is, the cable insert holes 4*a* and 4*b* are automatically returned to a position coaxially aligned with hole 5*a*. Therefore, if the cable insert nozzle is moved by one pitch to a predetermined position on the header plate, such as by a manipulator on the basis of a manufacturing drawing of the heat-exchanger, then the opening 4*b* of the female die 4 automatically will be positioned in alignment with the bored portion of the header plate, and hence the operation of inserting the female die 4 into the bored portion of the header plate can be achieved easily. A slight error in disposition of the opening 4*b* of the female die 4 with respect to the bored portion of the header plate can be eliminated by rotation of the female die 4 along the spherical seat 5*b* of the male die 5.

Since the above-described coil spring 61 is disposed within the cable insert holes 4*a* and 5*a*, it does not cause any inconvenience in the nozzle operation and in the operation of inserting a cable, and yet the structure is simplified and compact.

It is to be noted that modification can be made such that one end of the coil spring 61 is fixedly secured to the female die 4 and the other end is fixedly secured to the male die 5. In addition, while a coil spring 61 is illustrated in FIG. 7, it is also possible to use a plurality of leaf springs in place of the coil spring.

The cable insert nozzle according to the present invention is characterized by the fact that a two-part type cable insert nozzle, including a female die or nozzle member and a male die or nozzle member defining there-between aspherical seat has automatic restoring means provided between the female die and the male die. More particularly, pressing means surrounding the male die can be disposed between a nozzle holder for coupling the female die and male die together and a flange portion fixedly secured to the outer circumference of a tubular portion of the male die and spaced from and opposed to the nozzle holder. Alternatively, a spring for biasing the male die can be provided within cable insert holes extending through the male die and the female die the capability of movement of the female die relative to the male die due to the spherical seat of the nozzle is not lost, and when the nozzle is separated from a tube end portion of a heat-exchanger, the female die always will be restored to a position of coaxial alignment with the male die. Therefore, merely by moving the nozzle by one pitch according to a manufacturing drawing, it is possible to insert the nozzle into another tube end portion.

While a principle of the present invention has been described above in connection with preferred embodiments of the invention, it is to be understood that many apparently widely different embodiments can be made without departing from the spirit of the invention.

What is claimed is:

1. A cable insert nozzle of the two-part type for use in inserting a cable into heat-exchanger tubes for the non-destructive inspection thereof, said nozzle comprising:

a male nozzle member having therethrough a cable insert hole extending in an axial direction, said male nozzle member having a partially spherical exterior surface;

a female nozzle member having an axially extending tube insertion portion to be inserted into a heat exchanger tube, said female nozzle member having therethrough a cable insert hole extending in an axial direction through said tube insertion portion, and said female nozzle member having a partially spherical interior surface complementary to said partial exterior surface of said male nozzle member;

said male and female nozzle members being in coupled engagement with said male nozzle member inserted into said female nozzle with said partially spherical exterior and interior surfaces thereof, respectively, in engagement and defining a spherical seat about which said male and female nozzle members are relatively swivelly movable;

nozzle holder member means, releasably fixed to said female nozzle member and bearing against said male nozzle member, for maintaining said male and female nozzle members in said coupled engagement, and restoring means, operable between said male and female nozzle members, for urging said female nozzle member to a predetermined position relative to said male nozzle member whereat said cable insert holes through said male and female nozzle members are aligned coaxially, and thereby for ensuring that, upon withdrawal of said tube insertion portion from one heat exchanger tube being inspected, said tube insertion portion will be sufficiently aligned with the opening of another heat exchanger tube to be inspected by movement of said cable insertion nozzle in a direction perpendicular to said axial direction of said cable insert hole through said male nozzle member, said restoring means comprising at least one coil spring compressed between said male and female nozzle members and located to not interfere with insertion of a cable through said cable insertion holes.

2. A nozzle as claimed in claim 1, further comprising a flange member secured to the exterior of said male nozzle member in spaced opposed relation to said holder member means, and wherein said at least one coil spring is positioned outwardly of said male nozzle member and is compressed between said holder member means and said flange member.

3. A nozzle as claimed in claim 2, wherein said restoring means comprises a single coil spring surrounding said male nozzle member.

4. A nozzle as claimed in claim 2, wherein said restoring means comprises a plurality of said coil springs.

5. A nozzle as claimed in claim 4, wherein said coil springs are spaced at equal intervals around said male nozzle member.

6. A nozzle as claimed in claim 4, wherein lines connecting center points of said coil springs form a rectangle.

7. A nozzle as claimed in claim 1, wherein said restoring means comprises a single said coil spring positioned within said cable insert holes in said male and female nozzle members.

8. A nozzle as claimed in claim 7, wherein said single coil spring is mounted within recesses formed in said cable insert holes.

* * * * *